US012043357B2

(12) United States Patent
Le Gall et al.

(10) Patent No.: US 12,043,357 B2
(45) Date of Patent: Jul. 23, 2024

(54) DIVING MASK WITH PRESSURE-BALANCING MEANS

(71) Applicant: DECATHLON, Villeneuve d'Ascq (FR)

(72) Inventors: Jean-René Le Gall, Villeneuve d'Ascq (FR); Erwan Loret, Villeneuve d'Ascq (FR); Carla Ramault, Villeneuve d'Ascq (FR); Olivier Fournet, Villeneuve d'Ascq (FR)

( * ) Notice: Subject to any disclaimer, the term of this patent is extended or adjusted under 35 U.S.C. 154(b) by 357 days.

(21) Appl. No.: 17/431,469

(22) PCT Filed: Mar. 5, 2020

(86) PCT No.: PCT/FR2020/050440
§ 371 (c)(1),
(2) Date: Aug. 17, 2021

(87) PCT Pub. No.: WO2020/178529
PCT Pub. Date: Sep. 10, 2020

(65) Prior Publication Data

US 2022/0135193 A1 May 5, 2022

(30) Foreign Application Priority Data

Mar. 6, 2019 (FR) ..... 1902284

(51) Int. Cl.
*B63C 11/16* (2006.01)

(52) U.S. Cl.
CPC ..... *B63C 11/16* (2013.01)

(58) Field of Classification Search
CPC ..... B63C 11/00; B63C 11/02; B63C 11/08; B63C 11/12; B63C 11/16; B63C 11/18;
(Continued)

(56) References Cited

U.S. PATENT DOCUMENTS 859,786 A * 7/1907 Steenerson ..... B63C 11/205 128/201.11
2,488,261 A 11/1949 Bedini
(Continued)

FOREIGN PATENT DOCUMENTS

CN 205872407 U 1/2017
CN 206087242 U 4/2017
(Continued)

OTHER PUBLICATIONS

Machine English translation of RU2000109694.
(Continued)

*Primary Examiner* — Colin W Stuart
(74) *Attorney, Agent, or Firm* — Cabinet Beau De Loménie; Brian Gordaychik; Jonathan Bingham

(57) ABSTRACT

Diving mask including a snorkel with a valve, the valve including a valve orifice configured to allow fluid circulation between an outside of the snorkel and an inside of the snorkel, and a valve closure member, which can move between an open position in which the valve orifice is open and a closed position in which the valve orifice is closed by the valve closure member, wherein the mask includes a balancing means for limiting a pressure difference between the internal pressure of the mask and the external pressure, the balancing means being configured to allow fluid circulation between the outside of the mask and the inside of the mask when the mask is used by a user and when the closure member is in the closed position.

20 Claims, 4 Drawing Sheets

(58) Field of Classification Search
CPC ..... B63C 11/20; B63C 11/205; B63C 11/207; B63C 2011/165; B63C 2011/182
See application file for complete search history.

(56) References Cited

U.S. PATENT DOCUMENTS

| | | | | |
|---|---|---|---|---|
| 2,534,568 | A * | 12/1950 | Bedini | B63C 11/16 128/201.11 |
| 2,918,918 | A * | 12/1959 | Rebikoff | B63C 11/205 2/436 |
| 10,793,239 | B2 | 10/2020 | Caprice et al. | |
| 2016/0297505 | A1 | 10/2016 | Caprice et al. | |
| 2017/0334531 | A1 | 11/2017 | Shiue | |
| 2018/0065719 | A1 | 3/2018 | Liao | |
| 2018/0319471 | A1 | 11/2018 | Thomas et al. | |
| 2019/0023366 | A1* | 1/2019 | Liao | B63C 11/205 |

FOREIGN PATENT DOCUMENTS

| | | | |
|---|---|---|---|
| CN | 107399417 | A | 11/2017 |
| CN | 108284931 | A | 7/2018 |
| CN | 207826506 | U | 9/2018 |
| CN | 208134586 | U | 11/2018 |
| CN | 208412071 | U | 1/2019 |
| EP | 3434578 | A1 | 1/2019 |
| FR | 3020620 | A1 | 11/2015 |
| KR | 101076701 | B1 | 10/2011 |
| RU | 2000109694 | A | 3/2002 |
| WO | 2015170013 | A1 | 11/2015 |
| WO | 2018027903 | A1 | 2/2018 |

OTHER PUBLICATIONS

English language abstract of WO2018027903.
English language of KR101076701.
English translation of CN205872407U.
English translation of CN108284931.
English language abstract of CN207826506U.
English translation of CN208134586U.
English translation of CN208412071U.

* cited by examiner

[Fig. 1]
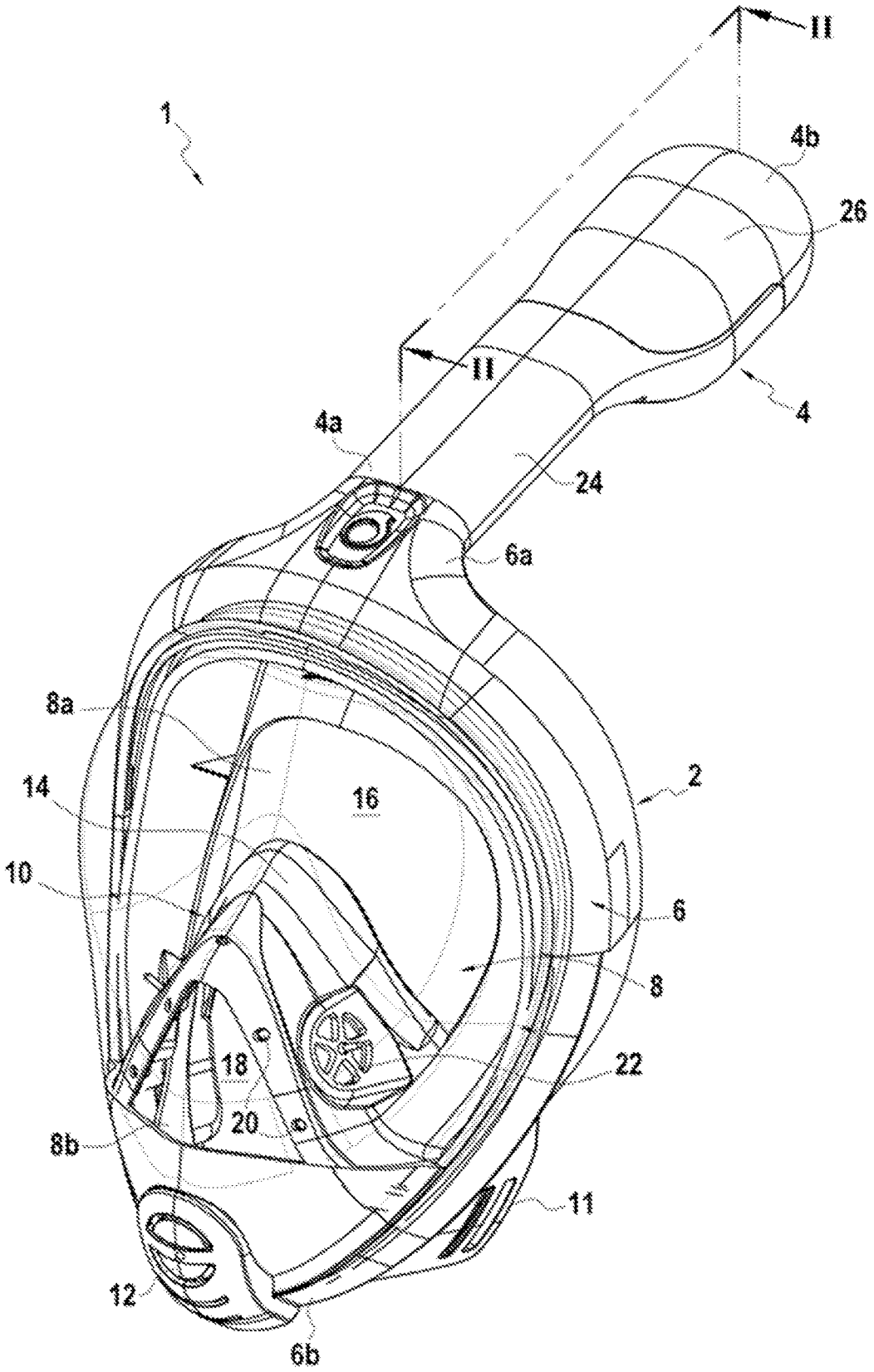

[Fig. 2]
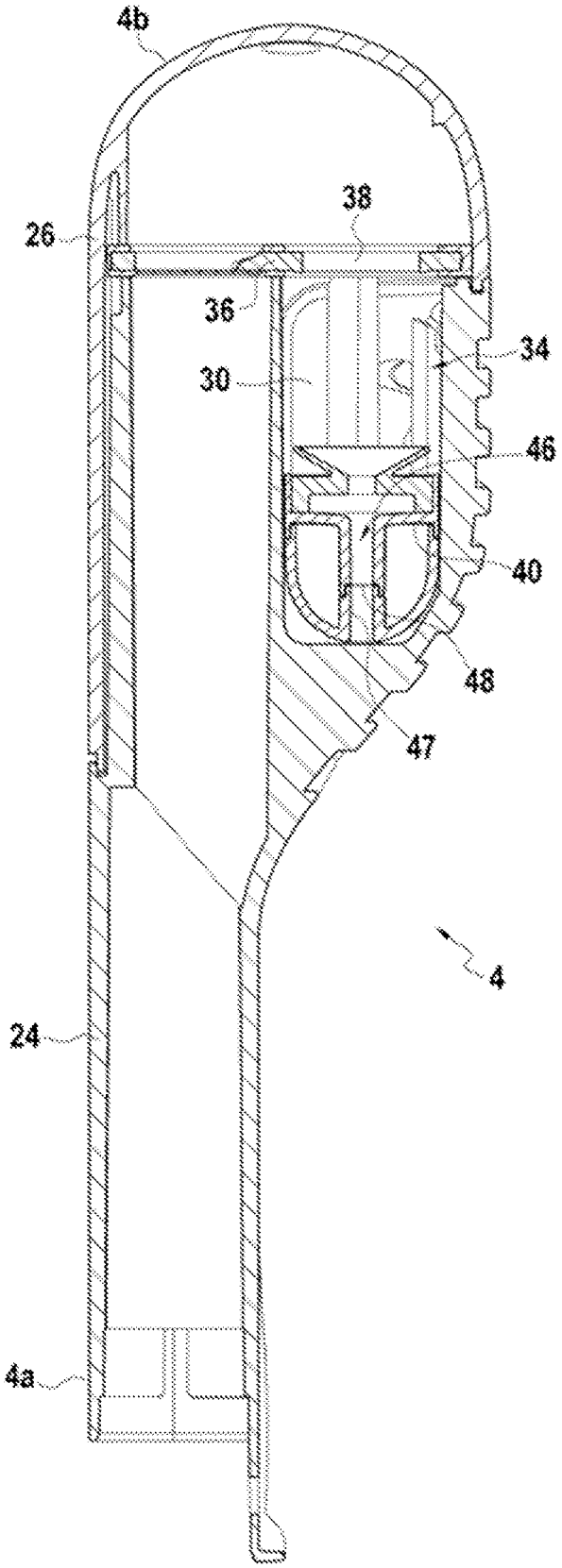

[Fig. 3]
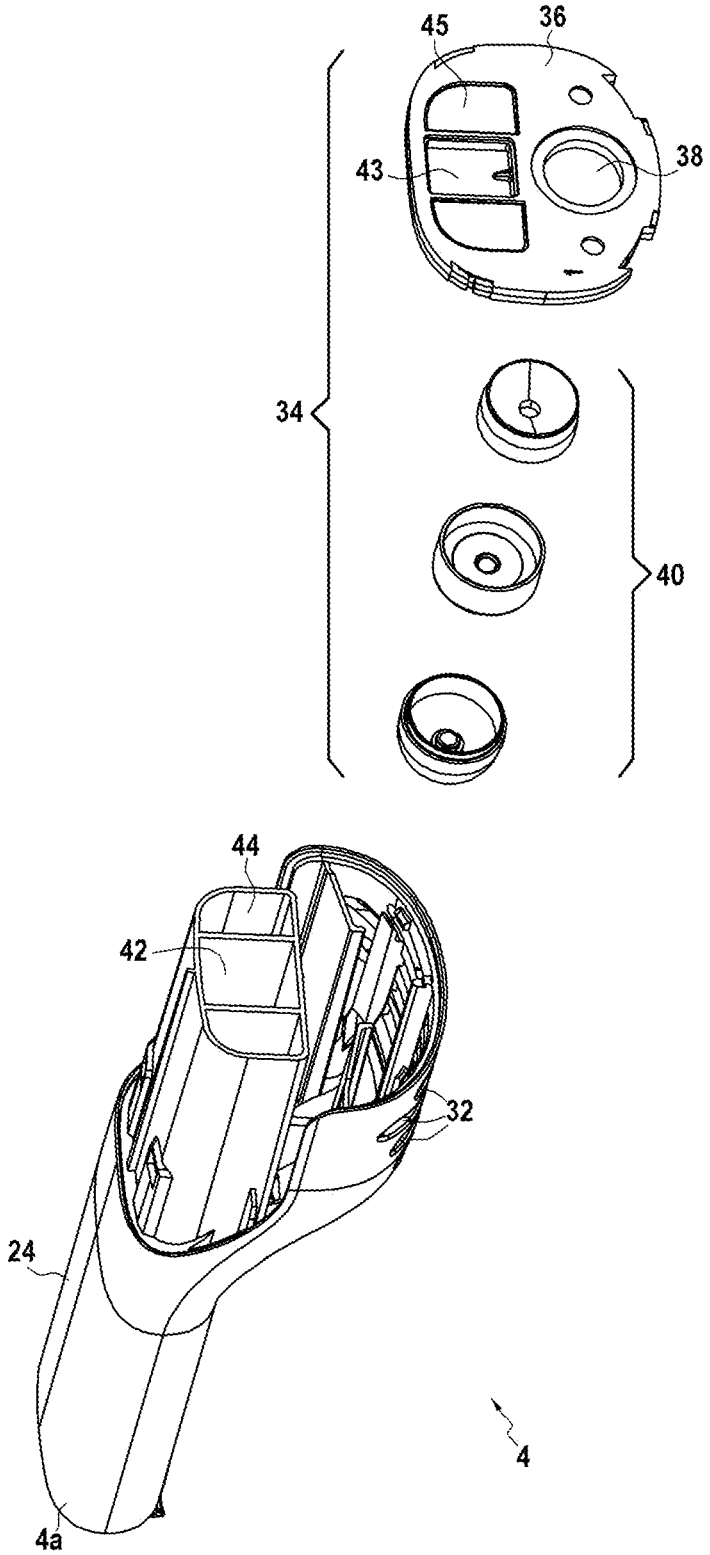

[Fig. 4]
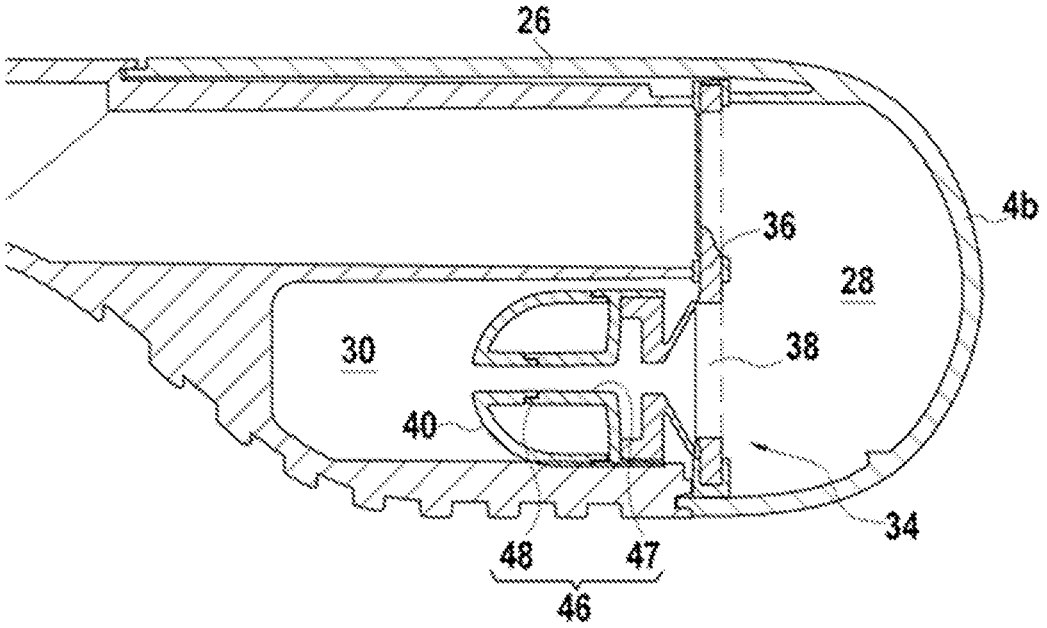

DIVING MASK WITH PRESSURE-BALANCING MEANS

TECHNICAL FIELD

The present disclosure relates to the field of diving masks, for example masks used for snorkeling.

PRIOR ART

Generally, the snorkeler is equipped with a mask for vision and with a snorkel for breathing. The snorkel consists of a tube, the lower end of which is provided with a buccal portion which is received in the mouth of the user, and an upper end allowing both the intake of fresh air and the exhaust of exhaled air.

It is known that such equipment has many drawbacks. First, because breathing through the mouth is not natural, some people find it difficult to breathe orally using a snorkel. Another drawback is that it is not possible to speak underwater when you have a snorkel in your mouth.

Also, the use of this mask-snorkel device is not very comfortable. To overcome this drawback, document FR 3 020 620 proposes a diving mask that allows breathing through the nose and through the mouth.

This diving mask includes: a body provided with a visor and a flexible skirt, said flexible skirt including a partition delimiting an upper chamber for the vision of a lower chamber for breathing, the partition being arranged to bear above the user's nose so that the user's mouth and nose are located in the lower chamber, while the user's eyes are located in the upper chamber, the partition including at least a passage arranged to allow a flow of fresh air between the upper chamber and the lower chamber during a phase of inhalation of the user; a snorkel disposed in the extension of an upper portion of the body, the snorkel comprising at least one air duct; in which the body includes an exhaled air exhaust device which fluidly links the lower chamber with the air duct of the snorkel.

This mask also includes a snorkel provided with several channels and a plate which includes check valves in order to close off the air outlet channels during an inhalation phase, on the one hand, and in order to close off the air inlet channel during an exhalation phase.

More specifically, the upper end of such a snorkel generally includes a valve allowing the closing of the snorkel when it is completely immerged, in order to prevent water from entering the mask.

However, sometimes after being completely immerged, the valve of the snorkel remains in the closed position, even after the user has returned to the surface of the water. In addition, in this case, the mask may also be more difficult for the user to remove by hand.

SUMMARY OF THE DISCLOSURE

The present disclosure aims at solving the various technical problems stated above. The present disclosure aims at proposing a diving mask that allows improving the reopening of the snorkel when it comes out of the water after having been completely immerged. The present disclosure also aims at facilitating the removal of the mask from the user's face after the snorkel has been completely immerged.

Thus, according to one aspect, a diving mask including a snorkel with a valve is proposed, the valve including:

- a valve orifice intended to allow fluid circulation, optionally of air, between the outside of the snorkel and the inside of the snorkel, and
- a valve closure member, optionally a float, which can move between an open position in which the valve orifice is open and a closed position in which the valve orifice is closed by the valve closure member, in which the mask also includes a balancing means for limiting a pressure difference between the internal pressure of the mask and the external pressure, the balancing means being configured to allow fluid circulation between the outside of the mask and the inside of the mask when the mask is used by a user and when the closure member is in the closed position.

Thus, it may be possible to balance the pressure difference which may appear between the inside and the outside of the mask. For example, when the snorkel is completely immerged, such that the valve is in the closed position, the user can create, possibly without meaning to do so, a depression inside the mask by trying to inhale. Such a depression can on the one hand create a suction effect of the mask on the face of the user, which can make the use of the mask unpleasant for the user, and on the other hand hold the valve of the snorkel in the closed position, even when the user pulls his head out of the water. Indeed, the valve generally includes a float which, when the level of the water reaches the upper end of the snorkel, closes off the valve under the effect of the buoyancy and which, when the level of the water goes down, reopens the valve under the effect of gravity. However, in case of depression inside the mask, the float may be held in the closed off position of the valve, thus preventing the user from breathing again as long as s/he has not exhaled in the mask to cancel depression. On the contrary, in the mask according to the present disclosure, the balancing means allows compensating for the pressure difference between the inside and the outside of the mask: this avoids having a depression inside the mask and therefore holding the valve in the closed position when the snorkel is out of the water. Optionally, the balancing means is configured to allow a fluid circulation, in this case a circulation of water and/or outside air, from the outside of the mask to the inside of the mask, when the mask is used by a user and when the closure member is in the closed position.

Optionally, the balancing means is mounted on the closure member.

Thus, the closure member of the valve may integrate the balancing means: the balancing means may then be positioned directly on the member which can close the internal volume of the mask. Such an embodiment may therefore allow creating a fluid connection between the inside and the outside of the mask only when the closure member closes off the valve that is to say only when the valve is in the closed position. Conversely, when the valve is in the open position, the closure member may be not in fluid connection with the interior of the mask, so that the balancing means cannot create a fluid connection between the inside and the outside of the mask.

Optionally, the valve includes a body in which the valve orifice is provided, and the balancing means is mounted on the valve body.

Thus, the balancing means may be mounted at the valve—the device capable of closing the internal volume of the mask. The balancing means may therefore be positioned to be immersed only when the valve is also immersed—in the closed position. This may avoid premature immersion of the balancing means, as long as the valve is not in the closed position.

Optionally, the snorkel includes a wall delimiting the inside of the snorkel relative to the outside, and the balancing means is mounted on the wall of the snorkel.

Thus, the balancing means may be mounted on the snorkel, between the valve and the body of the mask. This may make it possible, for example, when the snorkel includes both an inhaled air intake channel and at least a first exhaled air exhaust channel, to provide the balancing means on the exhaled air exhaust channel in order to avoid possible entry of water through the upper chamber of the mask.

Optionally, the snorkel includes a proximal portion and a distal portion. The snorkel may be on the body of the mask by the proximal portion. The balancing means may be mounted on the wall of the distal portion of the snorkel.

Optionally, the balancing means is mounted on the wall of the distal portion of the snorkel so that the valve is located between the proximal portion and the balancing means. Thus, it may be possible to mount the balancing means above the valve such that the balancing means can still be out of the water when the valve is in the closed position.

Optionally, the mask includes a body delimiting the inside of the mask relative to the outside, and the balancing means is mounted on the body of the mask.

Thus, the balancing means may be mounted directly on the body of the mask—on the immerged portion—when the mask is used. Such an embodiment may make it possible, for example, bring the water into the mask, in case of depression, at the desired location, optionally in the bottom portion of the mask—in the lower chamber of the mask.

Optionally, the balancing means has a tubular shape or is in the form of a hole.

The balancing means may allow a balancing between the internal pressure of the mask and the external pressure. To this end, one embodiment of the balancing means may consist of an opening between the inside of the mask and the outside, in order to allow fluid circulation between the two under the effect of a pressure difference. The opening can thus optionally be in the form of a small-sized hole, a tube or channel.

Optionally, the balancing means has a geometry configured to allow fluid circulation through the balancing means only when the pressure difference is greater than a determined value.

Thus, the balancing between the pressure inside the mask and the outside may occur only when the pressure difference is greater than a given value. This may avoid a possible excessive and unnecessary entry of water inside the mask: on the contrary, water may enter the mask by the balancing means only if the pressure difference is greater than a given value allowing fluid circulation in the balancing means. Such a given pressure difference value may optionally be due to the geometry of the balancing means. Thus, when the opening of the balancing means is particularly small, this may result in a significant pressure loss on either side of the balancing means: it may then be necessary to have a minimum pressure difference on either side of the balancing means to allow fluid circulation through said balancing means.

Optionally, the balancing means also includes a valve element, for example a flexible membrane, configured to allow fluid circulation through the balancing means only when the pressure difference is greater than a determined value.

Thus, the pressure difference required to open the balancing means may result, not only from the geometry of the balancing means, but also from the presence of a valve element in the balancing means. The addition of a valve element may allow for better controlling the pressure difference value necessary to obtain fluid circulation between the inside and the outside of the mask.

Optionally, the determined pressure difference value for which the balancing means is configured to allow circulation of a liquid between the outside of the mask and the inside of the mask, is greater than the determined pressure difference value for which the balancing means is configured to allow air circulation between the outside of the mask and the inside of the mask.

Thus, the balancing of the pressure difference may possibly be done in two stages, when the depression inside the mask is significant: in a first stage, when the balancing means is immersed, the pressure difference will decrease by the entry of water in the mask until the pressure difference reaches the determined value allowing circulation of a liquid through the balancing means, then, in a second stage, when the balancing means is again out of the water, the pressure difference will continue to decrease by the entry of air in the mask until the pressure difference reaches the determined value allowing circulation of a gas through the balancing means. This may limit the amount of water entering the mask under the effect of the pressure difference, while allowing the reopening of the valve and easy removal of the mask by hand by the user when the mask is again out of the water.

Optionally, the balancing means comprises a through channel.

Optionally, the balancing means is mounted in the float which generally has an elongated shape.

Optionally, the ratio of the area of the valve orifice to the area, for example the cross section, of the balancing means is greater than 1. Optionally, the ratio is comprised between 1 and 1,000,000. Optionally, the ratio is comprised between 10 and 100,000. Optionally, the ratio is comprised between 100 and 10,000.

It is understood that the balancing means is not intended to allow fluid circulation with a flow rate similar to that of the valve. The balancing means is provided, or configured, to decrease a pressure difference, not to allow the user to continue to breathe normally when the valve is in the closed position. Thus, the balancing means has a flow rate that allows a pressure balancing but which is lower than that of human breath. The user will be able to realize, in use, the closure of the valve, while having a pressure inside the mask which differs little from the one outside.

Optionally, the mask includes a body delimiting the inside of the mask relative to the outside, the body including:

- a frame surrounding the user's face,
- a visor surrounded by the frame,
- a flexible skirt fixed to the frame, the skirt including a partition delimiting an upper chamber for the vision of a lower chamber for breathing, the partition being arranged to bear above the user's nose such that the user's mouth and nose are located in the lower chamber, the partition including at least one passage arranged to allow circulation of inhaled air directed from the upper chamber to the lower chamber during a phase of inhalation of the user, wherein the frame, which may optionally be rigid, includes at least a first duct for the exhaled air, said first duct having an upper end opening inside the snorkel, and a lower end fluidly communicating with the lower chamber.

Optionally, the snorkel has an inhaled air intake channel and at least a first exhaled air exhaust channel, said snorkel being the extension of an upper portion of the frame, the inhaled air intake channel opening into the upper chamber while the first exhaled air exhaust channel communicates with the lower chamber, and wherein the first duct of the frame has an upper end opening into the exhaled air exhaust channel.

According to another aspect, a snorkel for a diving mask as described above is also proposed, the snorkel including a valve including:

- a valve orifice intended to allow fluid circulation between the outside of the snorkel and the inside of the snorkel, and,
- a valve closure member, optionally a float, which can move between an open position in which the valve orifice is open and a closed position in which the valve orifice is closed by the valve closure member,
- wherein the snorkel also includes a balancing means for limiting a pressure difference between the internal pressure of the snorkel and the external pressure, the balancing means being configured to allow fluid circulation between the outside of the snorkel and the inside of the snorkel when the mask is used by a user and when the closure member is in the closed position. Optionally, the balancing means is configured to allow fluid circulation, in this case a circulation of water and/or outside air, from outside the snorkel to inside the snorkel, when the mask is used by a user and when the closure member is in the closed position.

BRIEF DESCRIPTION OF THE DRAWINGS

FIG. 1 is a perspective view of a diving mask according to the disclosure, comprising a snorkel;

FIG. 2 is a sectional view of the snorkel of the mask of FIG. 1, when the valve is in the open position;

FIG. 3 is a partial exploded view of the snorkel of FIG. 2;

FIG. 4 is a partial sectional view of the snorkel of the mask of FIG. 1, when the valve is in the closed position.

DETAILED DESCRIPTION

FIG. 1 represents an exemplary embodiment of a diving mask 1 according to the present disclosure. The diving mask 1 includes a body 2 and a snorkel 4 mounted, optionally removably, on the body 2.

The body 2 comprises for example a frame 6, a visor 8 and a flexible skirt 10.

The frame 6 is generally oblong with an upper portion 6*a* and a lower portion 6*b*, and forms, in use, a banding surrounding the user's face.

The frame 6 may also include a first duct for the exhaled air (not represented) making it possible to convey, at least partly, the air exhaled by the user to the snorkel 4, for example from the lower chamber defined below, and a first duct for the inhaled air (not represented) making it possible to convey, at least partly, the inhaled air from the snorkel 4 to the user, for example to the upper chamber defined below.

The frame 6 finally includes slots 11 intended to receive one or more elastic straps (not illustrated here).

The visor 8 is secured to the frame 6. In this example, the visor 8 is made of a rigid and transparent plastic material, for example polycarbonate.

As can be understood from FIG. 1, the frame 6 surrounds the visor 8. In this non-limiting example, the frame 6 is a part distinct from the visor. Without departing from the scope of the present disclosure, the frame could however form a single piece with the visor.

Referring to FIG. 1, it is seen that the visor 8 is shaped to cover the face of the user. The visor includes a transparent flat portion 8*a* intended to be located substantially at the user's eyes, and a domed portion 8*b* intended to be located at the user's nose and mouth. In this non-limiting example, the domed portion 8*b* is transparent. However, and without departing from the scope of the present disclosure, the domed portion 8*b* could be opaque or transparent and covered with an opaque cover.

The visor 8 can also include a purge valve element 12 for the discharge of water which could have entered the mask 1. The purge valve element 12 can be mounted on the visor 8, in its lower portion, on the side of the lower portion 6*b* of the frame 6.

The skirt 10 is made of a flexible material, for example in a silicone elastomer such as LSR silicone. The skirt 10 is fixed to the visor 8 for example thanks to the frame 6 and is intended to provide the sealing between the inside of the mask 1 and the outside, efficiently and comfortably for the user.

The flexible skirt 10 includes a partition 14 delimiting an upper chamber 16 for vision, and a lower chamber 18 for breathing, the partition 14 being arranged to bear above the user's nose such that the user's mouth and nose are located in the lower chamber 18, while the user's eyes are located in the upper chamber 16.

The upper chamber 16 is in fluid communication with the first duct for the inhaled air of the frame 6, while the lower chamber 18 is in fluid communication with the first duct for the exhaled air of the frame 6.

The partition 14 is fixed to the visor 8 by an added fixing part which is clipped to fixing lugs 20 protruding from an inner face of the domed portion 8*b* of the visor 8.

The partition 14 includes two orifices which engage with the fixing lugs 20 before positioning the fixing part.

The partition 14 also includes two check valves 22 which are arranged to allow only a flow of fresh air directed from the upper chamber 16 to the lower chamber 18 during a phase of inhalation of the user.

Thus, during an exhalation phase, the exhaled air has the effect of closing the check valves 22, which has the effect of preventing the exhaled air from passing from the lower chamber 18 to the upper chamber 16. The exhaled air will therefore be conveyed from the lower chamber 18 to the snorkel 4 by the first duct for the exhaled air.

During an inhalation phase, the pressure drop which occurs in the lower chamber 18 has the effect of opening the check valves 22, whereby the fresh air can flow from the snorkel 4 to the lower chamber 18 by passing through the first duct for the inhaled air and the upper chamber 16.

The diving mask 1 also includes the snorkel 4, of generally tubular shape, with a proximal portion 4*a* connected to the upper portion 6*a* of the frame 6, and a distal portion 4*b* opposite the proximal portion 4*a*.

In this example, the proximal portion 4*a* of the snorkel 4 is mounted on the body 2 of the mask, for example on the frame 6, in a removable manner. The snorkel 4 can therefore be unclipped from the frame 6, which allows reducing the bulk of the mask 1 when the latter is not used.

In the example illustrated in FIGS. 2 to 4, the proximal portion 4*a* of the snorkel 4 has a general tubular shape delimited by a wall 24 and extending up to the distal portion 4*b*. The distal portion 4*b* is closed by a cover 26, or end-piece, and includes an internal chamber 28 and a cage 30 with air circulation openings 32 and a valve 34. The valve 34 allows the closure of the snorkel 4 when the latter is immerged, in order to avoid the entry of water into the mask 1, and for example includes a body 36 with a valve orifice 38 and a valve closure member 40.

The snorkel 4 comprises an inhaled air intake channel 42 and at least one exhaled air exhaust channel 44. The inhaled air intake channel 42 and the exhaled air exhaust channel 44 both extend between the proximal portion 4*a* of the snorkel 4 and the internal chamber 28 of the distal portion 4*b*. Thus, when the snorkel 4 is mounted on the body 2 of the mask, the inhaled air intake channel 42 of the snorkel is in fluid communication, at the proximal portion 4*a* of the snorkel 4, with the first duct for the inhaled air of the frame 6, and the exhaled air exhaust channel 44 is in fluid communication, at the proximal portion 4*a* of the snorkel, with the first duct for the exhaled air of the frame 6.

Furthermore, at the distal portion 4*b* of the snorkel, the inspired air intake channel 42 and the expired air exhaust channel 44 both open into the internal chamber 28, respectively through check valves 43 and 45 for fluidly linking the internal chamber 28 to the inspired air intake channel 42 when the user inspires, and to the expired air exhaust channel 44 when the user expires.

The internal chamber 28 is delimited on the one hand by the cover 26 and on the other hand by the valve body 36 and by the check valves 43, 45. As illustrated in FIG. 4, the valves 43, 45 and the valve orifice 38 can be produced in a single piece, for example in the form of a plate, forming the body of the valve 36.

The valve orifice 38 allows fluid circulation between the outside and the inside of the snorkel 4, for example between the outside and the internal chamber 28 of the snorkel 4. The closure member 40, for example a float, is mounted movable in translation, in the cage 30, relative to the valve body 36. The closure member 40 has for example an open position (see FIG. 2) in which the valve orifice 38 is open, and a closed position (see FIG. 4) in which it closes the valve orifice 38.

The operation is as follows.

When the snorkel 4 is out of the water, the float 40 is in the low position, so that air can flow from the inhaled air intake channel 42 or from the exhaled air exhaust channel 44, to the internal chamber 28 then to the atmosphere via the valve 34 and the openings 32 of the cage 30.

When the snorkel 4 is immerged, the float 40 rises to press against the valve body 36, which has the effect of closing off the valve orifice 38, as a result of which air cannot enter the snorkel 4.

For example, when the valve 34 is closed, the inside of the mask becomes a closed space which can be depressed if the user continues to inhale. A more pronounced crushing of the skirt 10 of the mask (suction effect) is then observed, which can be unpleasant for the user. In addition, the valve 34 can also remain in the closed position once the snorkel 4 has emerged, if the depression inside the mask 1 is greater than the weight of the float 40.

In order to avoid such drawbacks, the mask 1 according to the present disclosure includes a balancing means 46. As illustrated in FIGS. 2 to 4, the balancing means 46 is in the form of a through channel 47 disposed on the float 40 of the valve 34. When the valve 34 is in the closed position, the through channel 47 opens on one side to the outside of the mask 1, and on the other side to the valve orifice 38. Thus, even when the valve 34 is in the closed position, there is a fluid connection between the outside and the internal chamber 28 of the snorkel 4 via the balancing means 46. The balancing means 46 therefore allows compensating for a pressure difference between the inside and the outside of the snorkel 4, in order to avoid the suction effect or to avoid holding the valve 34 in the closed position.

In order to limit the entry of water into the mask 1, the through channel 47 of the balancing means 46 has a cross section much smaller than the area of the valve orifice 38. For example, the ratio of the area of the valve orifice 38 on the cross section of the through channel 47 may be greater than 1, optionally comprised between 1 and 1,000,000, optionally comprised between 10 and 100,000, optionally comprised between 100 and 10,000.

Furthermore, the balancing means 46 may also comprise a valve element 48, mounted in the through channel 47, and making it possible to create the fluid connection only when the pressure difference on either side of the balancing means 46 is greater than or equal to a determined pressure.

Alternatively, or in addition, the shape of the balancing means 46, for example its shape factor such as the ratio of the cross section to the length of the through channel 47, can also allow introducing a minimum pressure difference on either side of the balancing means 46 in order to obtain a fluid connection.

Thus, the balancing means 46 allows limiting the pressure difference that may exist between the inside and the outside of the mask 1, by allowing an entry of fluid (air or water) inside the snorkel 4, under the effect of the existing depression, when the valve 34 is in the closed state.

It should be noted that the figures represent only one embodiment of the present disclosure, in which the balancing means 46 is mounted on the closure member 40 of the valve 34. However, the present disclosure is not limited to this single embodiment, but also covers its variants.

Thus, the balancing means can be mounted on the body 36 of the valve 34, for example in the form of a hole, possibly with a valve element, positioned next to the valve orifice 38 and allowing the entry of fluid from outside in the internal chamber 28.

Alternatively, the balancing means can be mounted on the cover 26, so as to create a fluid connection between the outside and the internal chamber 28. In the latter case, it can be noted that the balancing means may allow the entry of air in the snorkel 4 if only the valve 34 is immerged, but not the entire cover 26.

Alternatively, the balancing means can be mounted on the wall 24 of the snorkel, in the proximal portion 4*a*, optionally between the outside and the exhaled air exhaust channel 44, so that water which can enter the mask 1 via the balancing means is found in the lower chamber 18 of the mask and not in the upper chamber 16.

Alternatively, the balancing means can be mounted on the body 2 of the mask, for example on the visor 8, in the bottom portion next to the purge valve element 12.

Thus, thanks to the balancing means according to the present disclosure, it may become possible to limit the pressure difference between the inside of the mask and the outside, when the valve is in the closed position. This may avoid a potential of blockage of the valve in the closed position when the mask is out of the water, as well as the difficulties in removing the mask by hand by the user, while limiting and controlling the possible amount of water entering the mask. The mask may thus become more comfortable and more pleasant to use, while providing the same functions and advantages as previously.

The invention claimed is:

1. A diving mask comprising a snorkel with a valve, the valve including:

a valve orifice configured to allow fluid circulation between an outside of the snorkel and an inside of the snorkel, and a valve closure configured to move between an open position, in which the valve orifice is open, and a closed position, in which the valve orifice is closed by the valve closure, wherein the mask includes a balancing means for limiting a pressure difference between an internal pressure of the mask and an external pressure on the mask, the balancing means being configured to allow fluid circulation from an outside of the mask to an inside of the mask when the mask is used by a user and when the valve closure is in the closed position.

2. The mask according to claim 1, wherein the balancing means is mounted on the valve closure.

3. The mask according to claim 1, wherein the valve includes a valve body in which the valve orifice is provided, and wherein the balancing means is mounted on the valve body.

4. The mask according to claim 1, wherein the snorkel includes a wall delimiting the inside of the snorkel relative to the outside of the snorkel, and wherein the balancing means is mounted on the wall of the snorkel.

5. The mask according to claim 4, wherein the snorkel includes a proximal portion and a distal portion, and the balancing means is mounted on the wall of the distal portion of the snorkel.

6. The mask according to claim 1, including a body delimiting the inside of the mask relative to the outside of the mask, and wherein the balancing means is mounted on the body of the mask.

7. The mask according to claim 1, wherein the balancing means has a shape configured to allow fluid circulation through the balancing means only when the pressure difference is greater than a determined value.

8. The mask according to claim 7, wherein the determined pressure difference value for which the balancing means is configured to allow circulation of a liquid between the outside of the mask and the inside of the mask, is greater than the determined pressure difference value for which the balancing means is configured to allow air circulation between the outside of the mask and the inside of the mask.

9. The mask according to claim 1, wherein the balancing means includes a valve element configured to allow fluid circulation through the balancing means only when the pressure difference is greater than a determined value.

10. The mask according to claim 9, wherein the valve element is a flexible membrane.

11. The mask according to claim 1, wherein the balancing means comprises a through channel.

12. The mask according to claim 1, wherein a ratio of an area of the valve orifice to an area of the balancing means is greater than 1.

13. The mask according to claim 12, wherein the ratio is between 10 and 100,000.

14. The mask according to claim 12, wherein the ratio is between 100 and 10,000.

15. The mask according to claim 1, including a body delimiting the inside of the mask relative to the outside, the body comprising:

a frame configured to surrounding the user's face, a visor surrounded by the frame, a flexible skirt fixed to the frame, the skirt including a partition delimiting an upper chamber for vision and a lower chamber for breathing, the partition being arranged to bear above a nose of the user such that a mouth of the user and the nose of the user are located in the lower chamber, the partition including at least one passage arranged to allow circulation of inhaled air directed from the upper chamber to the lower chamber during a phase of inhalation of the user, wherein the frame comprises at least a first duct for exhaled air, said first duct having an upper end opening inside the snorkel, and a lower end fluidly communicating with the lower chamber.

16. The mask according to claim 15, wherein the snorkel has an inhaled air intake channel and at least a first exhaled air exhaust channel, said snorkel being an extension of an upper portion of the frame, the inhaled air intake channel opening into the upper chamber while the first exhaled air exhaust channel communicates with the lower chamber, and wherein the first duct of the frame has an upper end opening into the exhaled air exhaust channel.

17. A snorkel for a diving mask comprising a valve including:

a valve orifice configured to allow fluid circulation between an outside of the snorkel and an inside of the snorkel, and a valve closure configured to move between an open position in which the valve orifice is open and a closed position in which the valve orifice is closed by the valve closure, wherein the snorkel includes a balancing means for limiting a pressure difference between an internal pressure of the snorkel and an external pressure on the snorkel, the balancing means being configured to allow fluid circulation from the outside of the snorkel to the inside of the snorkel when the snorkel is a part of a diving mask used by a user and when the valve closure is in the closed position.

18. A diving mask comprising a snorkel with a valve, the valve including:

a valve orifice configured to allow fluid circulation between an outside of the snorkel and an inside of the snorkel, and a valve closure configured to move between an open position, in which the valve orifice is open, and a closed position, in which the valve orifice is closed by the valve closure, wherein the mask limits a pressure difference between an internal pressure of the mask and an external pressure on the mask, the mask being configured to allow fluid circulation from an outside of the mask to an inside of the mask when the mask is used by a user and when the valve closure is in the closed position.

19. The mask according to claim 18, wherein the diving mask includes a valve element configured to allow fluid circulation through a balancing means only when a pressure difference is greater than a determined value.

20. The mask according to claim 19, wherein the valve element is a flexible membrane.

* * * * *